United States Patent [19]

Dennesen et al.

[11] Patent Number: 4,592,277

[45] Date of Patent: Jun. 3, 1986

[54] DRIVE FOR STENCILLING APPARATUS

[76] Inventors: Joseph C. Dennesen, 62 Bridge St., Beverly, Mass. 01915; Richard S. Wilson, 7 Superior St., Swampscott, Mass. 01907

[21] Appl. No.: 690,111

[22] Filed: Jan. 9, 1985

[51] Int. Cl.[4] ..... B41F 17/22

[52] U.S. Cl. ..... 101/38 R; 101/126

[58] Field of Search ..... 101/38 R, 38 A, 124, 101/126

[56] References Cited

U.S. PATENT DOCUMENTS

| | | | |
|---|---|---|---|
| 2,304,725 | 12/1942 | Bauman | 101/124 |
| 2,492,052 | 12/1949 | Martin | 101/124 |
| 2,747,502 | 5/1956 | Gattuso | 101/126 |
| 2,845,859 | 8/1958 | Gattuso | 101/126 |
| 2,968,239 | 1/1961 | Zumbehl | 101/126 X |
| 3,078,792 | 2/1963 | Kerstan | 101/126 |
| 3,874,289 | 4/1975 | Valentin | 101/126 X |

FOREIGN PATENT DOCUMENTS

| | | | |
|---|---|---|---|
| 644570 | 6/1928 | France | 101/38 R |

*Primary Examiner*—Clifford D. Crowder
*Attorney, Agent, or Firm*—Alan N. McCartney

[57] ABSTRACT

A stencilling apparatus having a single drive means operating a container fixture screen support and wiper fixture, so that the container fixture rotates and moves toward and away from the screen, and the screen moves laterally and the wiper moves toward and away from the screen all in timed sequence to wipe a screen pattern on the container.

8 Claims, 12 Drawing Figures

DRIVE FOR STENCILLING APPARATUS

BACKGROUND OF THE INVENTION

1. Field of the Invention

An apparatus for stencilling a pattern on a workpiece such as a bottle.

2. Summary of the Prior Art

In stenciling a pattern on a workpiece, such as, a bottle type container, a pool of paint or ink is placed on the upper surface of a silk screen which is located above the container. The container is then positioned proximate to the under surface of the screen and a wiper presses down on the upper surface of the screen which is then passed over the container to permit the wiper to wipe the screen pattern onto the container surface. At the same time, the container is rotated to properly spread the image of the pattern onto the surface of the container. An example of such a stencilling apparatus is illustrated in U.S. Pat. No. 3,260,194.

In the stencilling of containers it is desirable to automatically position the workpiece, screen and wiper with respect to one another so that the pattern is automatically placed on the workpiece.

BRIEF SUMMARY OF THE INVENTION

In a stencilling apparatus, it is desirable to use a power source to laterally move a silk screen back and forth between a container and a wiper. Also, the same power source lowers the wiper onto the screen and forces a paint on the upper surface of the screen through the screen onto the container. Further, during this operation, the power source should raise and lower the fixture supporting the container so that the container can be removed and successive containers stencilled. Also, it is desirable to raise and lower the fixture supporting the wiper so that the wiper can be spaced from the screen during certain printing sequences.

It is an object of this invention to provide a common drive source for laterally moving a silk screen between a container and a wiper and for raising and lowering the container and wiper toward and away from the silk screen and for rotating the container during the screening process. An electrical motor drives a shaft mounting the container supporting fixture to rotate the container. A pinion on the shaft coacts with a rack supporting the screen mounting fixture for lateral movement of the screen. The rack supports a rear roller coacting with a rear cam to move the shaft and container supporting fixture up and down to move the container toward and away from the screen. The screen mounting fixture supports a forward cam coacting with a forward cam follower on the wiper supporting fixture to move the wiper toward and away from the screen. The coaction of the latter cam and cam follower permits the wiper to be raised from the screen at the end of each stroke past the end of the paint puddle being spread and then lowered beyond the end of the puddle for respreading the paint. This prevents puddling of the paint beyond the wiper stroke to make the maximum use of the paint. Further, during the initial lateral stroke of screen, a pattern can be placed on one container and on the return stroke a pattern can be applied to a successive container.

Provision is also made for easily modifying the forward and rear cams to permit one way printing when applying more than one color of paint to the container for a multi-colored label.

DESCRIPTION OF THE PREFERRED EMBODIMENT

Figure 1:
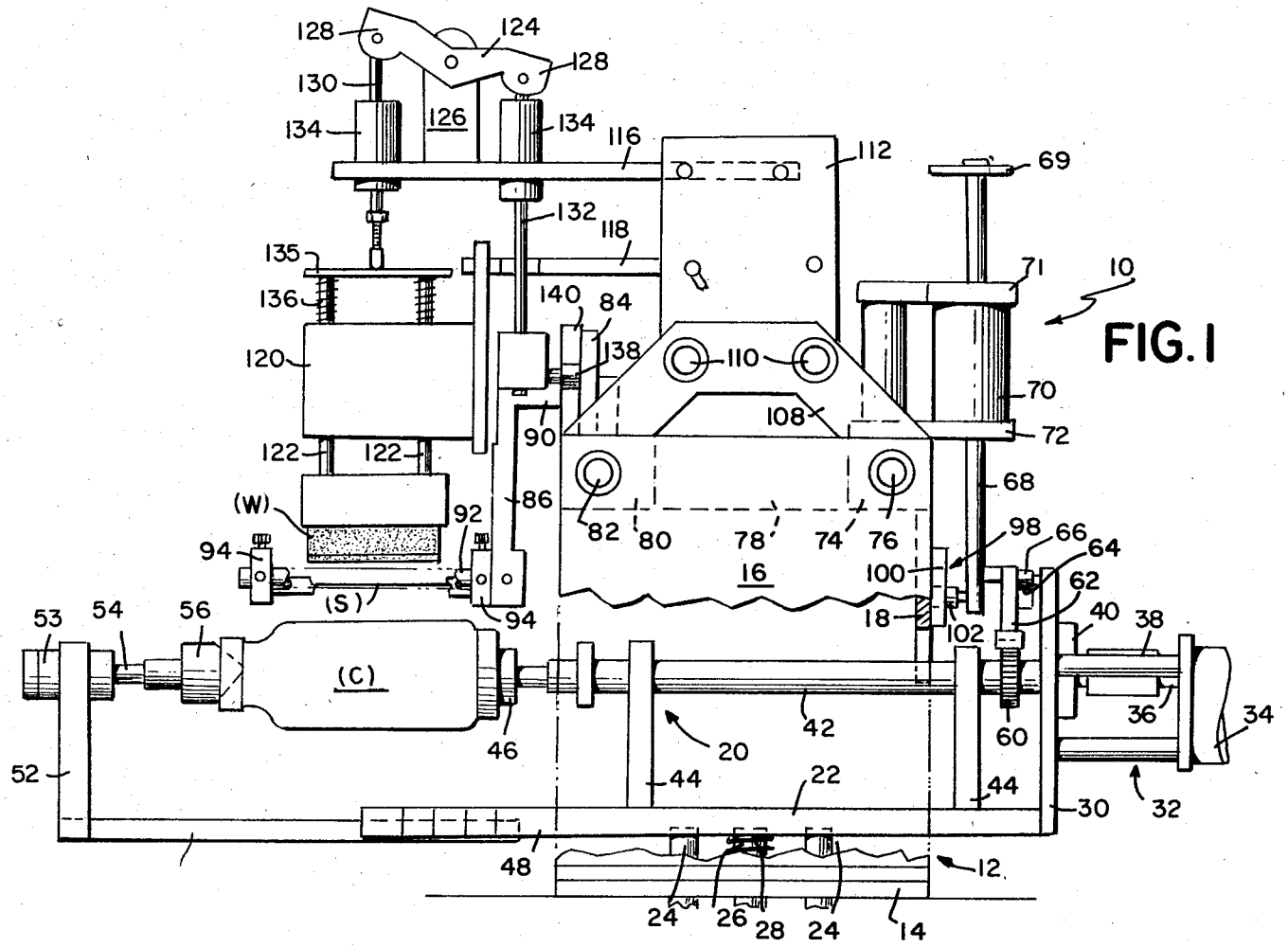
FIG. 1 is a side elevational view, partially broken away, of the stencilling apparatus of this invention.

Attention is directed to FIG. 1 which illustrates the stencilling apparatus 10 as having a support frame 12 comprising a base plate 14, opposed upstanding side members 16 and a rear plate 18 secured to the side members 16.

The container support fixture 20 is mounted on plate 22 supported on posts 24 slidably carried in the base plate 14. A central post 26 is surrounded by a spring 28 to cushion the support of plate 22 on base plate 14.

Secured to the plate 22 is a flange 30 supporting the mounting 32 for the motor 34. The shaft 36 of motor 34 extends through a coupling 37 and a bearing 40 in flange 30. The motor shaft 36 is connected to the drive shaft 42 of the container support 20. The shaft 42 is supported on plate 22 by brackets 44. The end of shaft 42 carries the rear container (c) support 46.

Slidably supported on the front 48 of plate 22 is the forward container support 50. The support 50 has an upwardly extending flange 52 carrying a cylinder 53 having a piston rod 54 with an adapter 56 positioned in the opening of the container (c). The cylinder 52 permits the adapter 56 to be withdrawn and inserted into the container opening for removal and insertion of the container into the apparatus 10 during each stencilling sequence. It can thus be seen from this mounting of the container (c) in the fixture 20 that the motor 34 will rotate the container (c).

Figure 2:
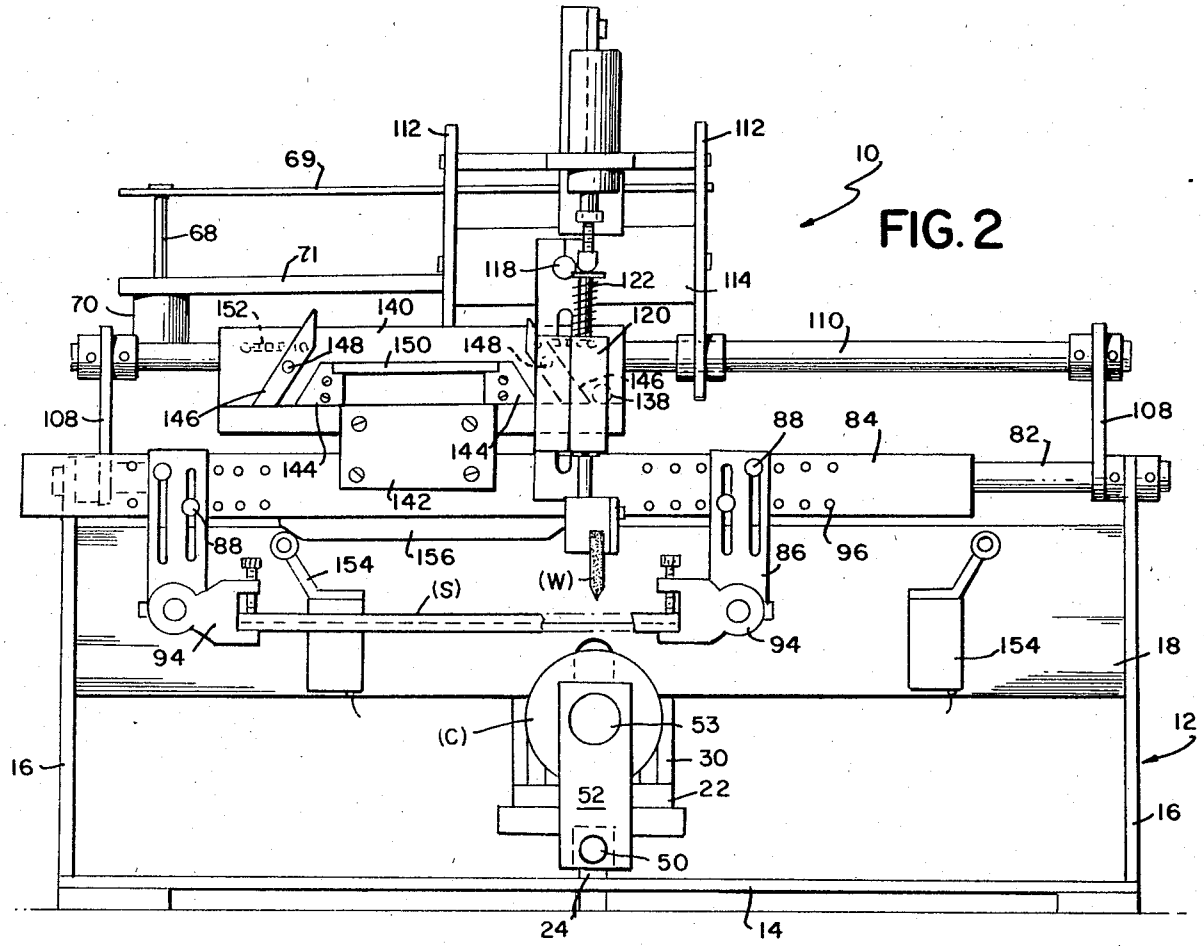
FIG. 2 is a front view of the apparatus.
Figure 3:
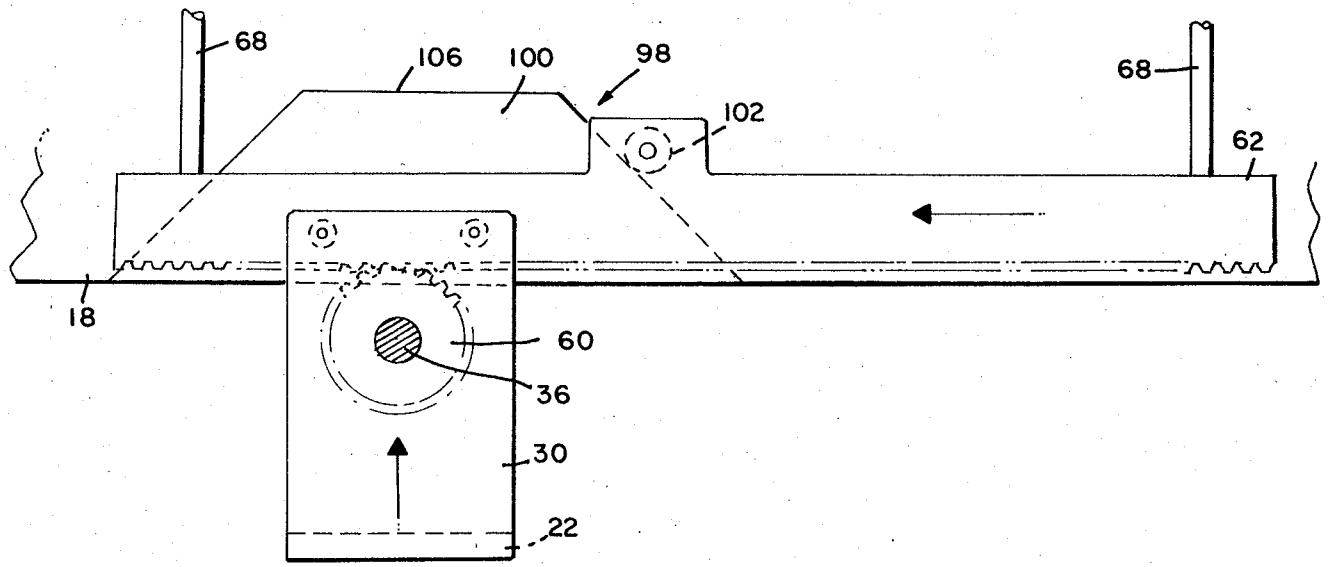
FIG. 3 is a diagrammatic view illustrating the rack and pinion drive from the motor for laterally moving the screen mounting fixture and the cam for raising and lowering the container support fixture.

Attention is now directed to FIGS. 1, 2 and 3 which illustrate the fixture for supporting the silk screen (s) for back and forth lateral movement between the container (c) and a wiper (w). The shaft 42 has a pinion 60 engaging a rack 62 supported on bearings 64 on flange 30. The bearings 64 engage rails 66 on the rack 62.

Mounted to rack 62 are a pair of posts 68 slidably carried in housings 70 mounted on flanges 72 which are secured to bearings 74 slidably carried on shaft 76 mounted between side plates 16. The posts are interconnected by a plate 69 and the housings are interconnected by a plate 71.

A plate 78 secured to bearings 74 is attached to the bearings 80 slidably carried on shaft 82 attached between side plates 16. An upwardly extending flange 84 is secured to plate 78. Arms 86 are bolted at 88 through bushings 90 to the flange 84. The arms carry rods 92 which support the inner and outer brackets 94 for carrying the screen (s) as shown in FIG. 2. The flange 84 contains a plurality of openings 96 for lateral adjustment of the arms 86 to accommodate various lengths of screens (s).

It can thus be seen from the above description that the motor driven rack and pinion will cause the posts 68 and housings 70 to slide on shaft 76 which will laterally move the plate 78. The arms 86 supporting screen (s) through the interconnection of flange 84 to plate 78, will laterally move the screen (s) back and forth above the container (c).

Mounted to the rear of the apparatus 10 is a camming arrangement 98 which causes the container support 20 to raise and lower so that containers (c) can be inserted and removed during sequential labeling operations. Mounted to the rear plate 18 is a cam 100 and mounted to the rack 62 is a cam roller 102. As the rack travels back and forth causing lateral movement of the screen (s), the roller 102 sides up the cam 100 causing the plate 22 to rise away from the base plate 14 (though the sliding post interconnection). The shaft 42 passes through a slot in plate 18 and the entire container support is raise to position the container (c) against the screen (s). As the screening process occurs, the roller remains on the upper surface 106 of cam 100 and the container remains against the screen (s) as the screen is laterally travelling over the container. At the same time, the container is being rotated from drive motor 34. At the completion of the screening, the roller 102 slides down cam 100 to lower the container for removal and the insertion of the next container in sequence to be stencilled.

Figure 4:
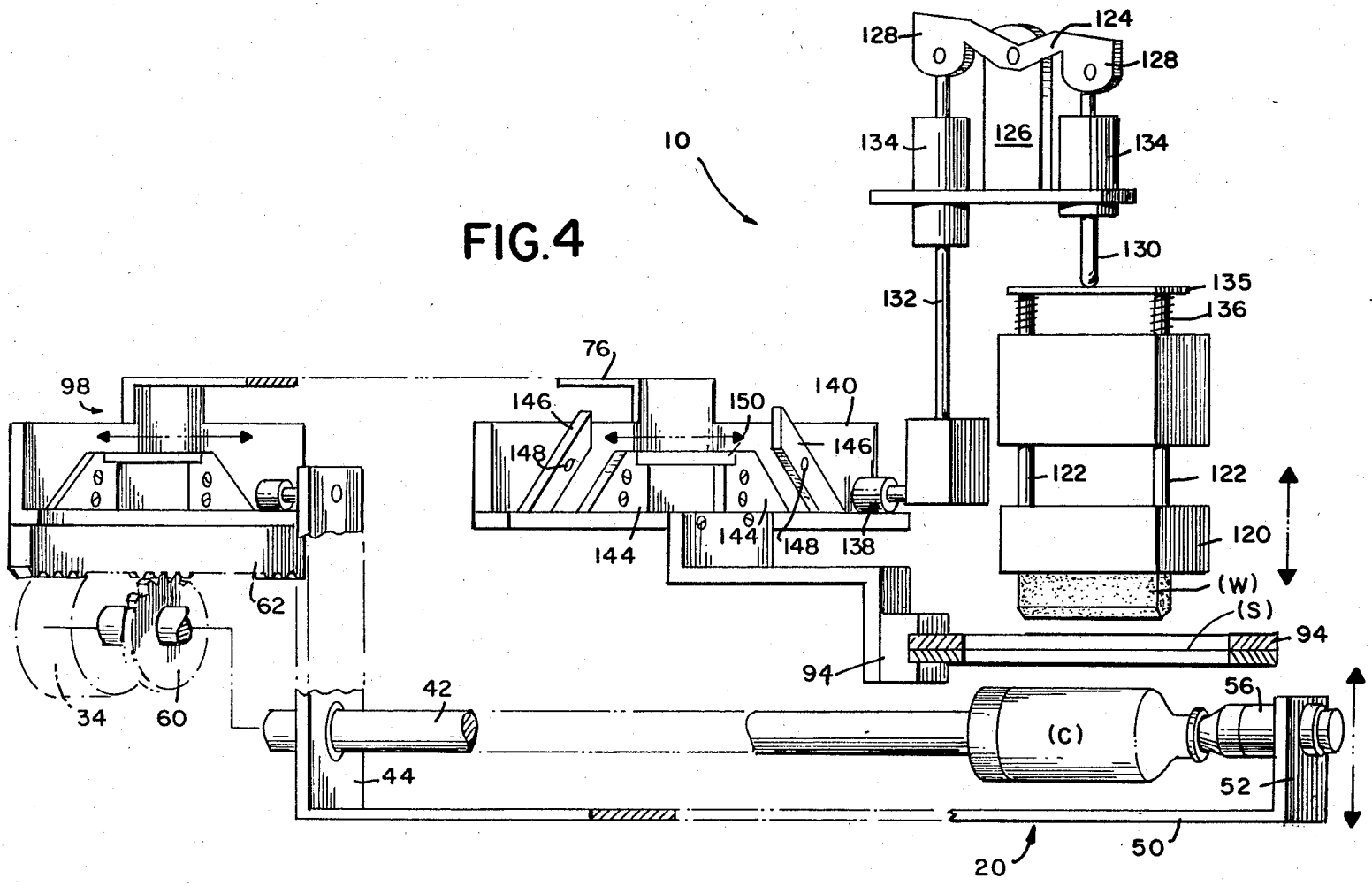
FIG. 4 is a diagrammatic perspective view of the container fixture, screen support and wiper fixture and the drive and camming action for moving the container up and down, the screen laterally and the wiper up and down during the stencilling operation.
Figure 5A:
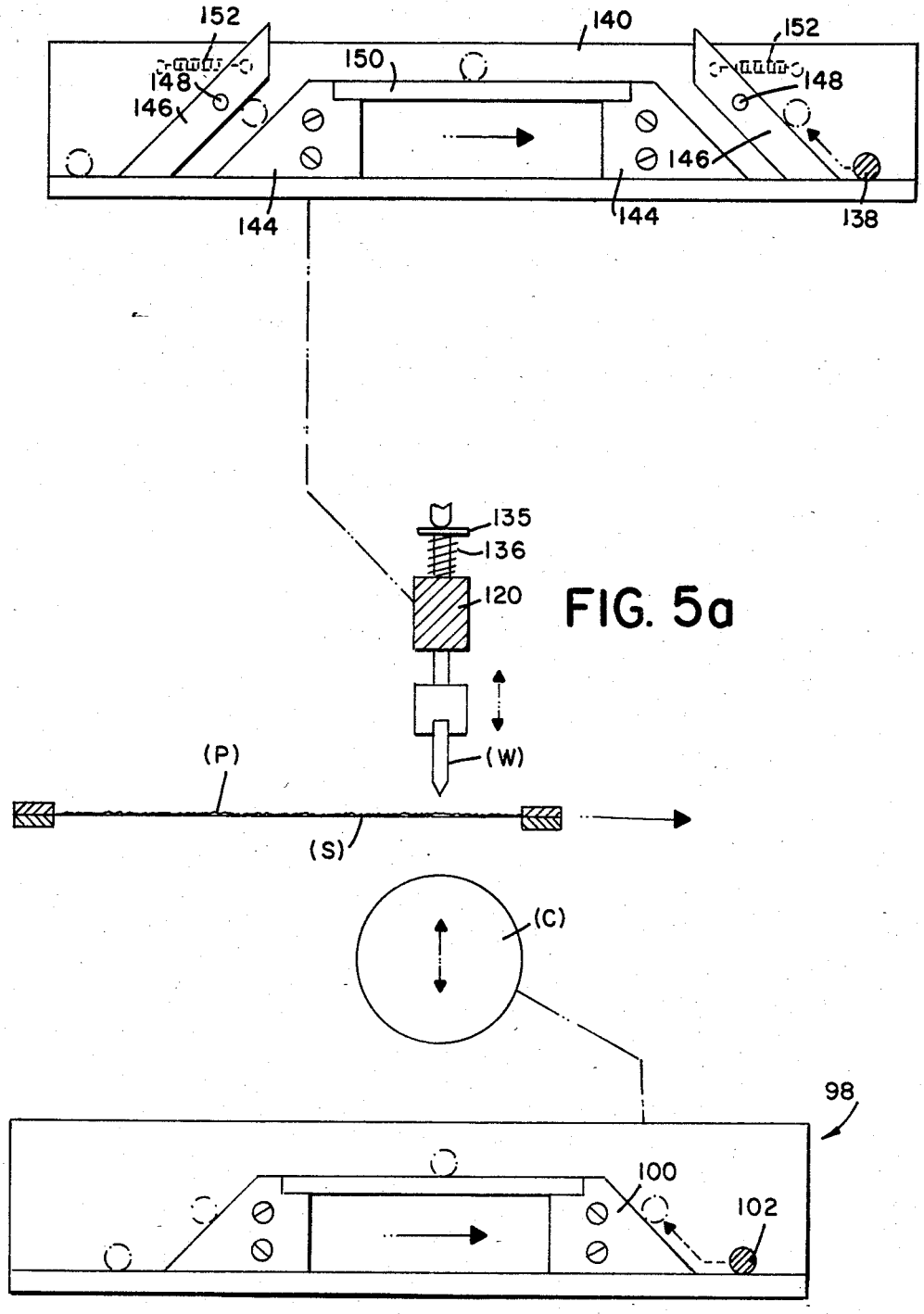
FIGS. 5(*a*) to 5(*g*) are diagrammatic illustrations of the various positions of the container, screen and wiper during a two way printing sequence; and, FIG. 6 is a diagrammatic illustration of the various positions of the container, screen and wiper during a one way printing sequence.
Figure 5B:
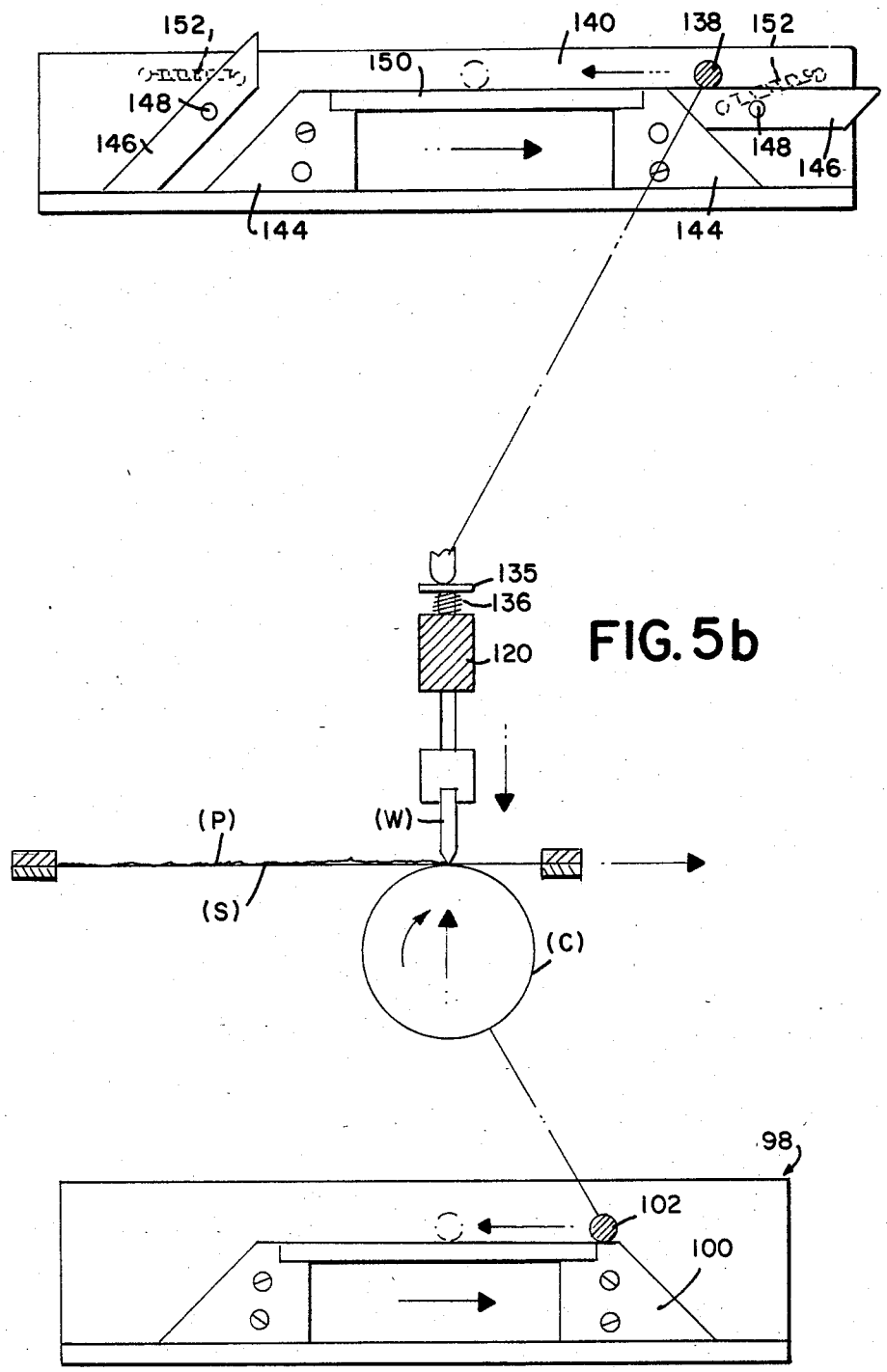
Figure 5C:
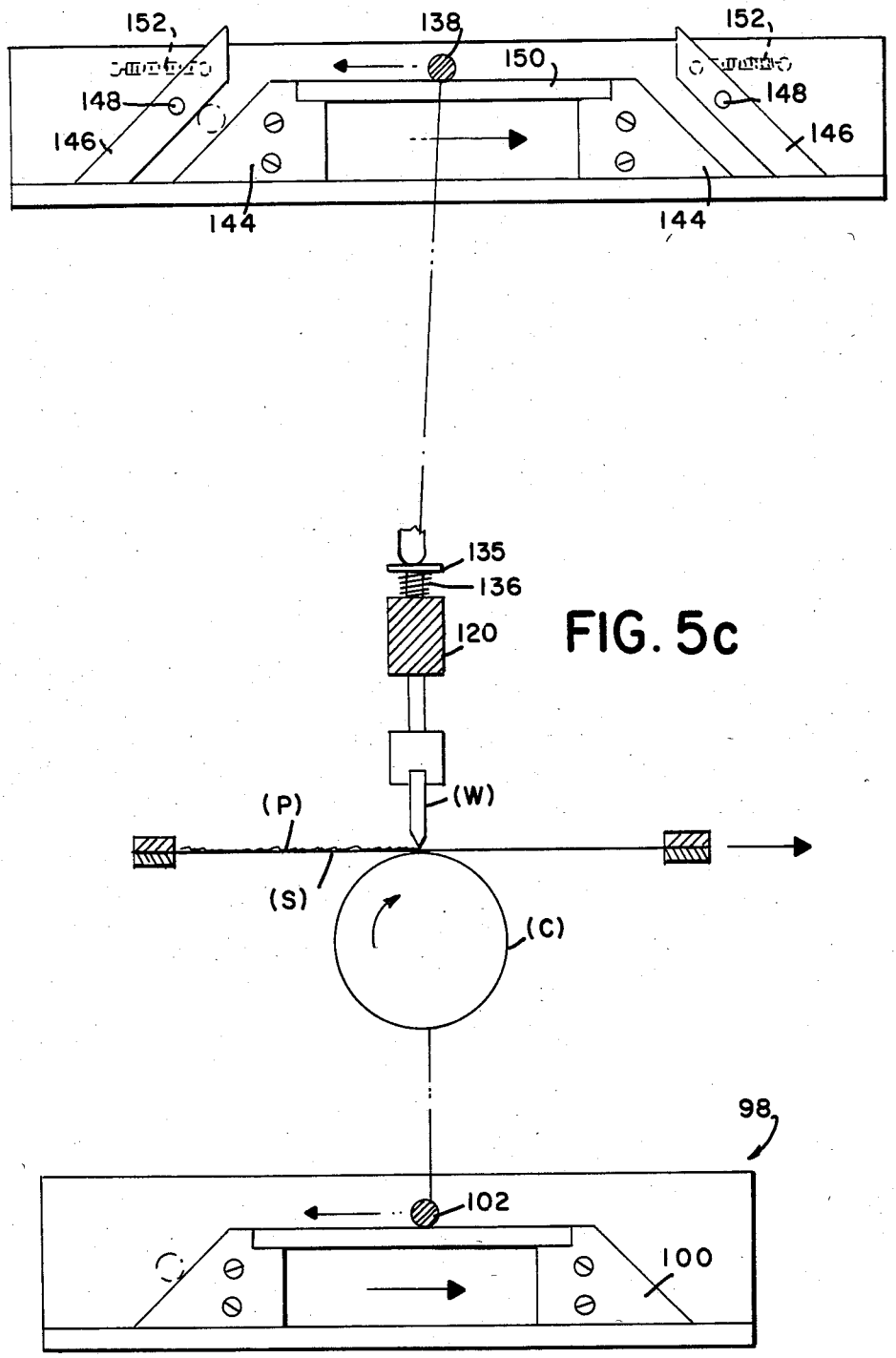
Figure 5D:
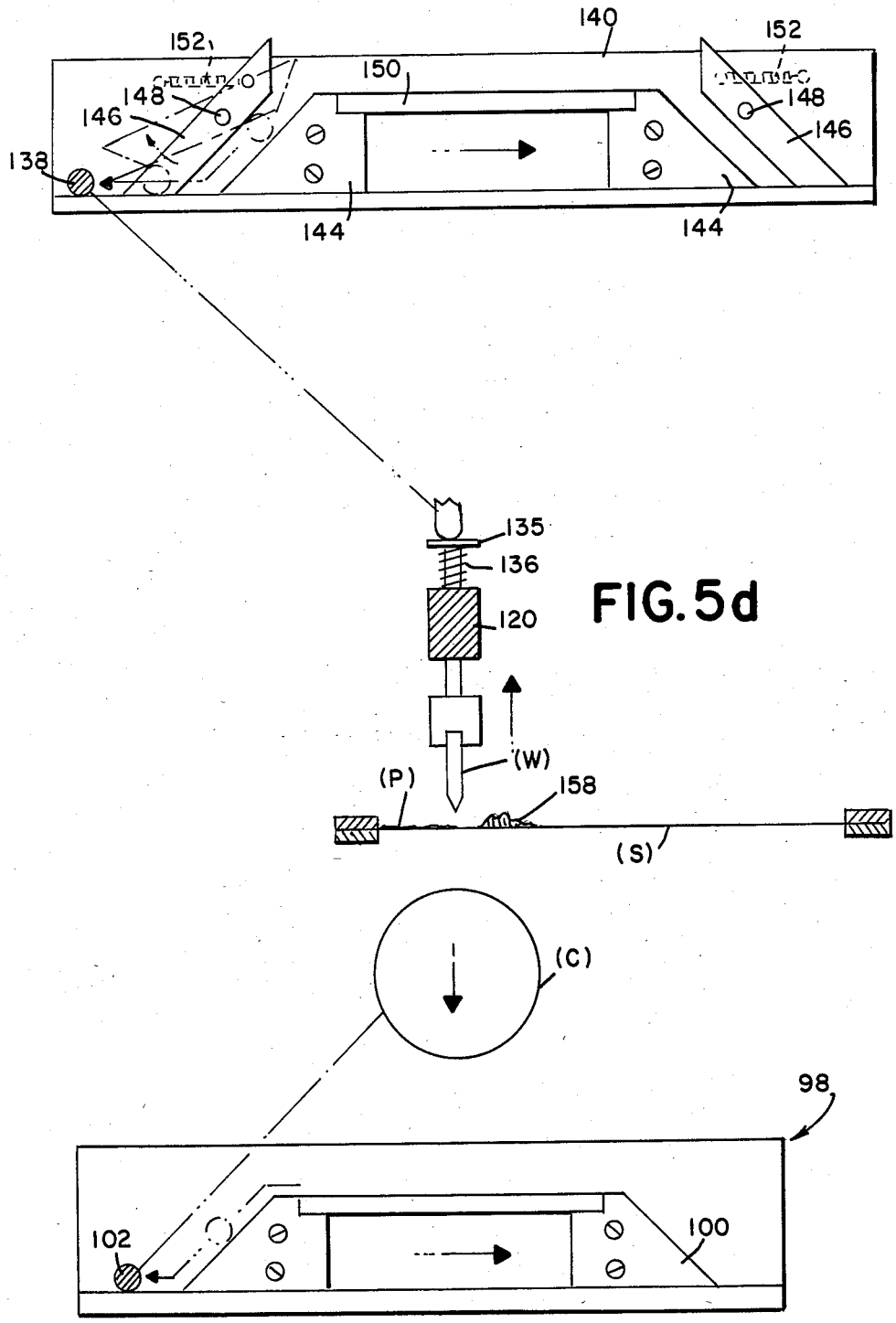
Figure 5E:
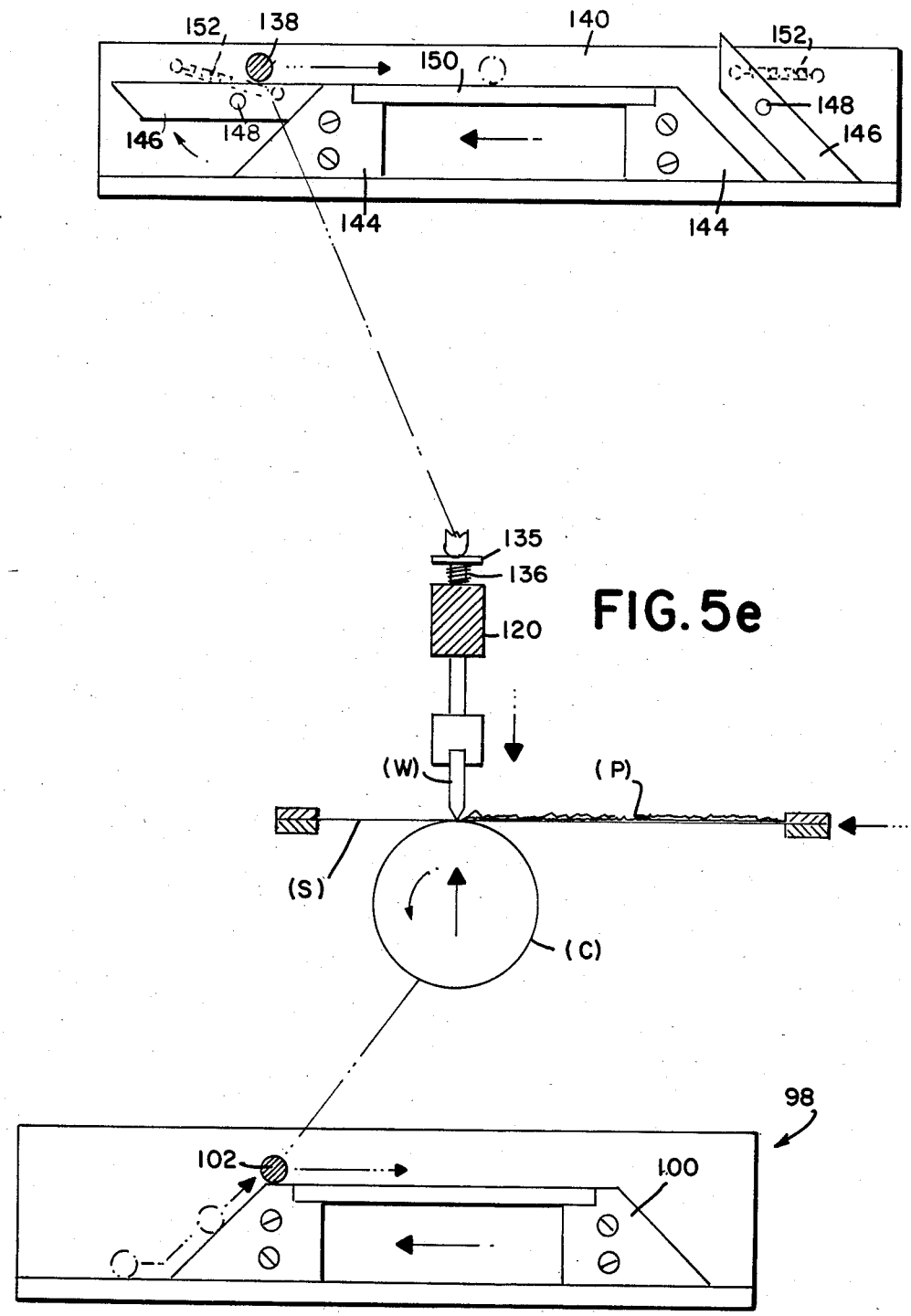
Figure 5F:
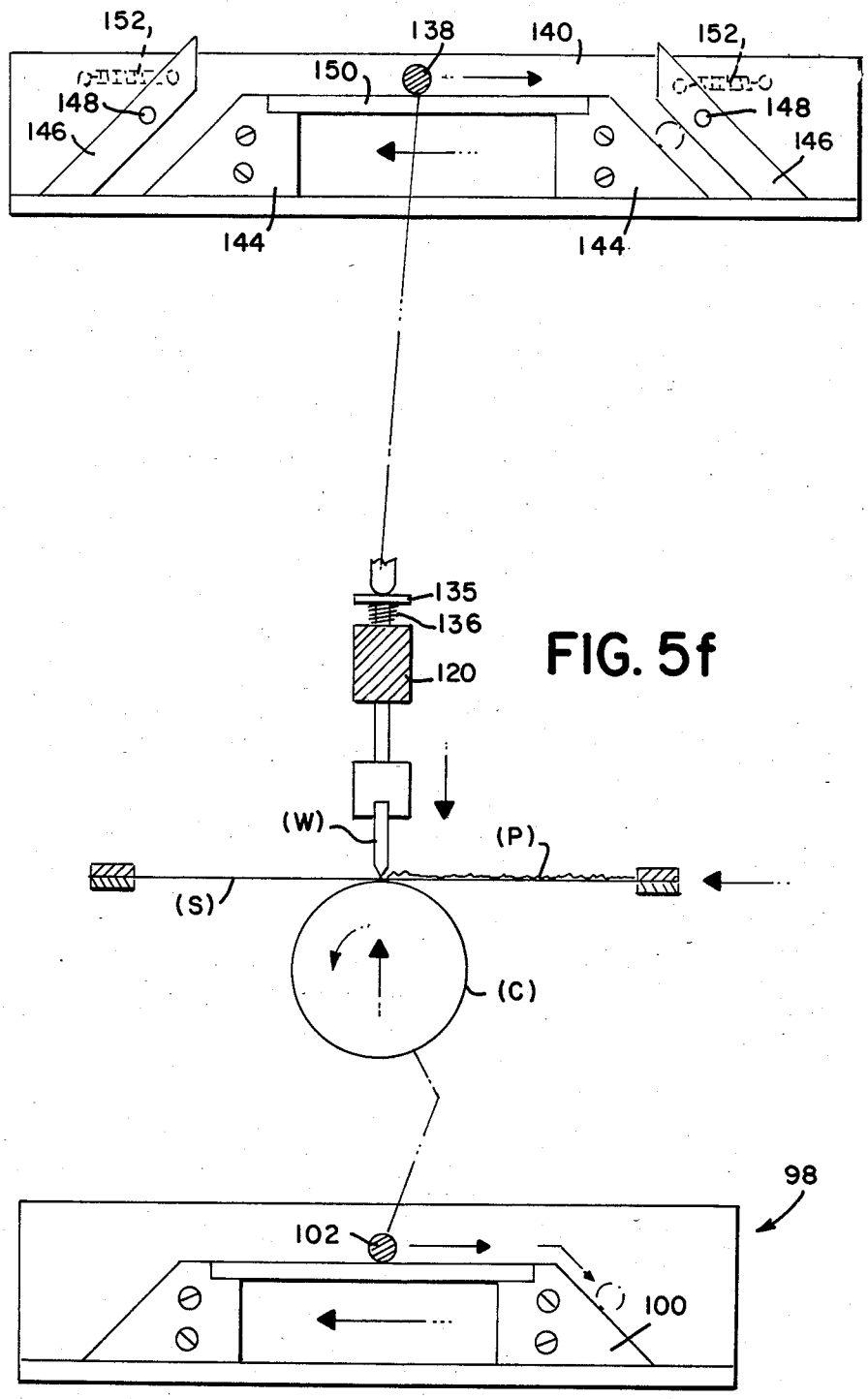
Figure 5G:
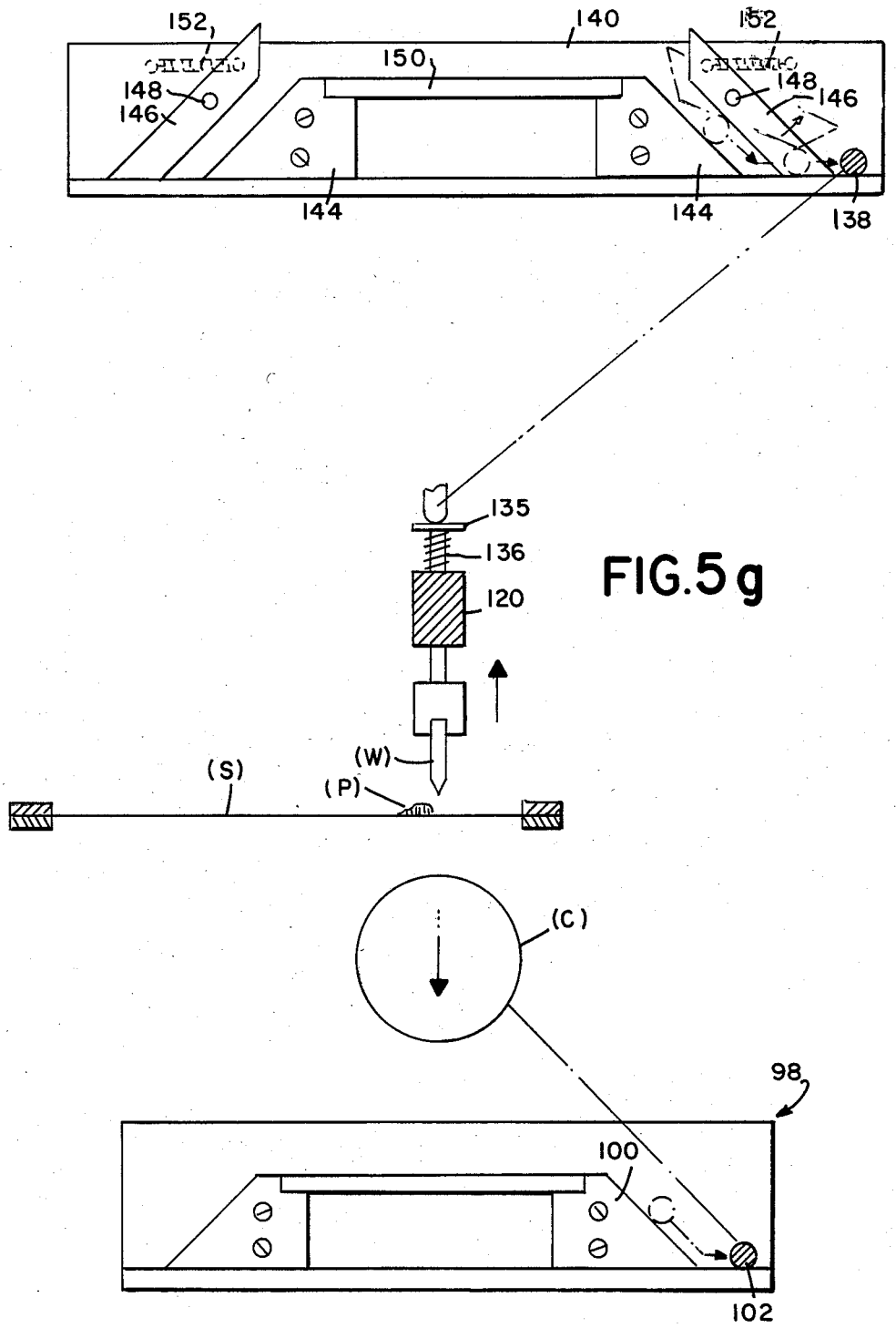

Attention is now directed to FIGS. 1, 2 and 4 which illustrate the mechanism for raising and lowering the wiper (w) at the proper timed sequence during screening. A pair of upwardly extending mounting plates 108 are secured to the shafts 76 and 82 and have cross support shafts 110. Slidably, positioned on the shafts 110 are side supports 112 secured together by a back plate 114. Slidably positioned on the supports 112 and back plate 114 are upper and lower support arms 116 and 118, respectively. The arm 118 carries a support block 120 for the wiper (w). The wiper (w) is carried on support rods 122 slidably positioned in the block 120. A rocker arm 124 is pivoted to a flange 126 on the upper arm 116. The ends 128 of rocker arms 124 carry rods 130, 132 which pass through bushings 134 on the upper arms 116. The rod 130 abuts against the plate 135 on the ends of rods 122. Springs 136 positioned between the block 120 and plate 135 upwardly bias the rocker arm 124 to the position illustrated in FIG. 1.

The rod 132 carries a roller 138 which coacts with the cam plate 140 mounted on the flange 84 by a plate 142 (see FIG. 2). The cam plate 140 comprises inner cam ramps 144 and outer cam ramps 146 pivotably attached at 148 to the cam plate 140. Secured between the cam ramps 144 is a plate 150. Cam ramps 146 are biased by springs 152 into a lowered position as illustrated in FIG. 2.

From the above description it can be seen that as the flange 84 travels back and forth, the cam plate 140 will cause the roller 138 to ride up the ramps 146 causing the rod 132 to be raised. The rocker arms 124 rotates which forces the rod 130 downward to move the wiper (w) onto the screen (s) to spread the paint (p).

Attention is now directed to FIG. 4 which diagrammatically illustrates the entire movement of the container, screen and wiper, all of which originates from the single motor drive. As the motor is driven, rotation of shaft 42 rotates the container (c). At the same time, the rack and pinion drive will cause the lateral movement of the screen (s). As the rack 62 moves laterally the rear cam 98 will cause the container (c) to move upwardly to a position below the screen. Further, the interconnection of the rear rack with the cam plate 140 causes the front cam to lower the wiper onto the surface of th screen to wipe the paint (p) on the screen to form the screen pattern on the container. Limit switches 154 coacting with cam 156 on plate 18 will reverse motor 34 to reverse the stroke of the printing.

Reference is now made to FIGS. 5(*a*) to 5(*f*) which diagrammatically illustrates the sequence of operation for two way printing, that is, printing a single color paint on a container on each stroke of the screen.

The directional arrows in FIGS. 5(*a*) to 5(*f*) illustrates the movements of the various parts of the apparatus. FIG. 5(*a*) illustrate the screen, container and wiper in a start up condition. As the motor is driven (FIGS. 5*b*). The roller 102 rides up cam 100 and moves the container to the underside of the screen. At the same time, the motor rotates the container. The lateral movement of the cam plate 140 causes the roller 138 to ride up outer ramp 146 forcing the wiper (w) onto the screen (s). Continued movement of the parts as illustrated in FIG. 5(*c*) will wipe the screen pattern onto the container. As the stroke of operation continues, as illustrated in FIG. 5(*d*), the rollers ride down their respective cams and the wiper and container separate from the screen. At this point, the container is removed and the next container is sequence is inserted for printing.

At the end of a given stroke, as illustrated in FIG. 5(*d*), a puddle 158 of ink is left at the surface of the screen. To permit the wiper to travel beyond the puddle 158 to collect the puddle on the return stroke, the set of ramps 144, 146 is utilized. As the roller 138 reaches the end of plate 150, the roller 138 will travel down inner ramp 144 to raise the wiper (w). On the return stroke the roller 138 will ride up cam 146 placing the wiper (w) back down onto screen (s) slightly beyond the puddle 158. This permits a maximum use to be made of the paint.

FIGS. 5(*e*) and 5(*f*) illustrate the return stroke of the screen and the printing of the next container in sequence.

Figure 6:
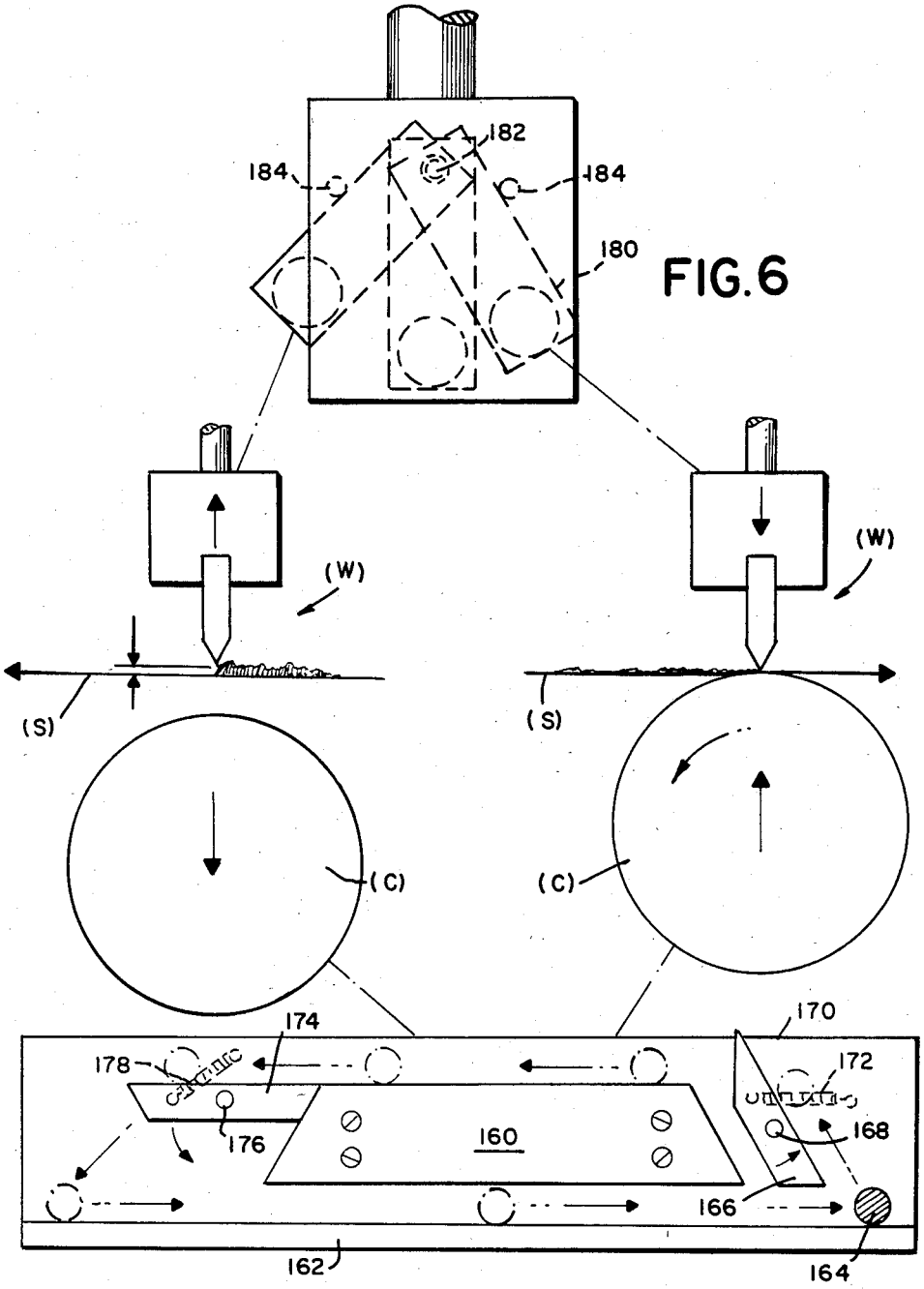

In some applications, it is desirable to perform only one way printing, that is, printing only one container on each back and forth movement of the screen. FIG. 6 illustrates a modification of the camming arrangement for the wiper (w) and container (c) that keeps the wiper raised and container lowered on the return stroke so that only one way printing is accomplished. Again, the various motions by the parts are illustrated by arrows.

Th rear cam 160 is raised above a surface 162 so that the roller 164 travels on lower surface 162 on the return stroke. the right hand outer cam ramp 166 is pivoted at 168 to the plate 170 and biased downwardly by spring 172. The left hand cam ramp 174 is pivoted at 176 to plate 170 and biased upwardly by spring 178. Thus, as the rear cam roller 164 travels from right to left in FIG. 6, the roller rides up ramp 166 to move the container to the screen. On the return stroke, the roller 164 rides down ramp 174 and onto surface 162 to keep the container lowered on the return stroke.

In the FIG. 6 modification, the interconnection of wiper (w) to the block 120 is through a pivoted link 180.

The link 180 is pivoted to block 120 at 182 and supports the wiper (w). Stop pins 184 limit the pivotal movement of the link 180. As the wiping action commences, as illustrated in the right hand side of FIG. 6, the wiper (w) will be pressed against the screen and the link 180 will assume a 5 o'clock position.

At the completion of the printing stroke, the link 180 will assume a 7 o'clock position as illustrated in FIG. 6 so that the wiper (w) will be slightly raised above the surface of the screen (s). At this time, the spacing of wiper (w) is only slightly above the screen (s) so that upon the return stroke, the paint is spread across the screen (s).

From the above description, it can be seen that a single drive is utilized for all movements of the container, screen and wiper during printing for both two way and one way printing of a container.

We claim;

1. A stencilling apparatus for wiping a pattern of paint through a screen onto a container, comprising:

a. a frame;

b. a screen support mounted on said frame for lateral back and forth movement;

c. a container fixture mounted on said frame for rotationally supporting a container and for movement toward and away from said screen support, d. a wiper fixture mounting on said frame and having a wiper for movement toward and away from said screen support, e. a single drive means for rotating said container and causing said screen support movement, said container fixture movement and said wiper fixture movement in timed sequence for wiping the pattern on the container, and f. said screen support containing a camming device including a cam, said cam coacting with a cam follower on said wiper fixture to cause movement of said wiper fixture toward and away from said screen support.

2. The stencilling apparatus of claim 1 wherein said drive means includes a rack and pinion coacting with said screen support to cause said screen support lateral movement.

3. The stencilling apparatus of claim 2 wherein a roller on said rack coacts with an additional cam on said screen support to cause said container fixture movement.

4. The stencilling apparatus of claim 1 wherein said cam follower includes a roller on said wiper fixture and said cam includes dual cam ramps coacting with said roller to cause said wiper to be adjacent to and spaced from said screen support during each lateral movement of said screen support.

5. The stencilling apparatus of claim 1 wherein said drive means includes a rack on said screen support, and a pinion on said drive means causing said screen support movement.

6. The stencilling apparatus of claim 1 wherein the coaction of said cam and said cam follower causes said wiper to move away from said screen support at the end of said screen support lateral movement and toward said screen support before further movement occurs of said screen support.

7. The stencilling apparatus of claim 6 wherein said cam includes opposed inner and outer cam ramps whereby said cam follower contacts said inner cam ramp in one position of movement of said screen support and said outer cam ramp in another position of movement of said screen support.

8. The stencilling apparatus of claim 6 including means disengaging said cam and said cam follower during one movement of said screen support.

* * * * *